United States Patent [19]

Samuelson et al.

[11] Patent Number: 4,728,007

[45] Date of Patent: Mar. 1, 1988

[54] DISPENSING ASSEMBLY WITH NOZZLE STORAGE

[75] Inventors: Bruce E. Samuelson, West Lakeland Township, Washington County; Carl S. Ahlberg, Minneapolis; Daryl E. Vosberg, Cottage Grove, all of Minn.

[73] Assignee: Minnesota Mining and Manufacturing Company, Saint Paul, Minn.

[21] Appl. No.: 919,855

[22] Filed: Oct. 16, 1986

[51] Int. Cl.[4] ..... B67D 5/06

[52] U.S. Cl. ..... 222/182; 222/538; 222/567

[58] Field of Search ..... 141/379, 325, 326, 327; 222/538, 540, 567, 570, 182

[56] References Cited

U.S. PATENT DOCUMENTS 1,411,573 4/1922 McGarrahan ..... 222/538

1,600,379 9/1926 Werneman ..... 222/538

4,520,951 6/1985 Facey ..... 222/538

*Primary Examiner*—Houston S. Bell, Jr.

*Attorney, Agent, or Firm*—Donald M. Sell; James A. Smith; William L. Huebsch

[57] ABSTRACT

A dispensing assembly including an internally pressurized container of viscous liquid which may be dispensed through a hollow stem by deflecting the directing tube and stem to open a valve and cause liquid to flow out through an outlet opening in the directing tube. An overcap having a cavity adapted to receive the stem and directing tube releasably engages the container and has at least one, and preferably two, sockets along its inner surface for storing elongate hollow tapered application nozzles. The application nozzles have inlet ends adapted for engagement around the outlet opening on the directing tube so that the nozzles can be used to apply the liquid as it is discharged from the container.

7 Claims, 4 Drawing Figures

DISPENSING ASSEMBLY WITH NOZZLE STORAGE

TECHNICAL FIELD

The present invention relates to hand held dispensing assemblies for liquids including separable application nozzles.

DISCLOSURE OF THE INVENTION

According to the present invention there is provided a hand held dispensing assembly particularly adapted for use to dispense and apply viscous caulking liquids which solidify when exposed to atmospheric conditions, which dispensing assembly provides storage means for at least one separable application nozzle through which the liquid is dispensed, and means for sealing valve means and means for directing through which the liquid is dispensed after the application nozzle is removed and the liquid is not being dispensed to restrict solidification of the liquid within the valve means and means for directing.

The dispensing assembly according to the present invention comprises an internally pressurized container of viscous liquid, which container includes valve means and means for directing liquid discharged through the valve means to an outlet opening including a hollow projecting stem, which valve means can retain the liquid within the container when the stem is in a central position, and allows flow of the liquid from the pressurized container through the means for directing when the stem is pivoted relative to the container about the end of the stem adjacent the container. Also included is an elongate hollow tapered application nozzle having an inlet end adapted for releasable engagement with the means for directing around the outlet opening and an outlet end by which the liquid may be distributed in desired areas (e.g., such as in a crack or in the space between a window or door frame and a wall) when the valve means is opened. The dispensing assembly also includes an overcap comprising a wall defining a cavity adapted to receive the means for directing and having a lip defining an inlet opening to the cavity, which lip is adapted to releasably engage the container around the means for directing. The overcap has a socket within the cavity for receiving and releasably retaining the nozzle to store it so that a user can remove the nozzle from the socket and attach it to the means for directing when the dispensing assembly is to be used.

Preferably, the overcap includes two sockets within the cavity of the overcap, and two elongate tapered nozzles, one releasably retained within each of the sockets, which is particularly useful for dispensing liquids that will solidify when exposed to atmospheric conditions so that the dispensing assembly can be used on two different occasions without cleaning the nozzles or for use to dispense liquids through application nozzles having different outlet opening sizes.

Preferably the means for directing includes, in addition to the stem, a hollow generally L-shaped directing tube having an inlet end portion engaged over the stem, an outlet portion disposed at an obtuse angle with respect to the inlet end portion and having a distal end defining the outlet opening and adapted to be frictionally engaged by the inlet end of the tapered nozzle, and a pressure plate on the side of the inlet end portion opposite the outlet end portion adapted for manual engagement to move the directing tube and thereby pivot the stem to open the valve means and afford flow of liquid from the container through the outlet opening and the tapered nozzle.

Also, the dispensing assembly preferably includes a cover movable from a position spaced from the directing tube to afford flow of liquid through the directing tube when the valve means is opened and to afford attaching the inlet end of the application nozzle around the outlet portion of the directing tube, and a position over the outlet opening and frictionally engaging the outlet portion to provide the means for sealing to thereby prevent liquid within the directing tube and stem from dripping out or solidifying from contact with the atmosphere.

The overcap of the dispensing assembly may also include a hanger portion at its end opposite the lip which has a through opening adapted to receive a support member from which the dispensing assembly may be hung when the overcap is engaged with the container, which may be advantageous for hanging the dispensing assembly on a sales display rack or in a shop.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
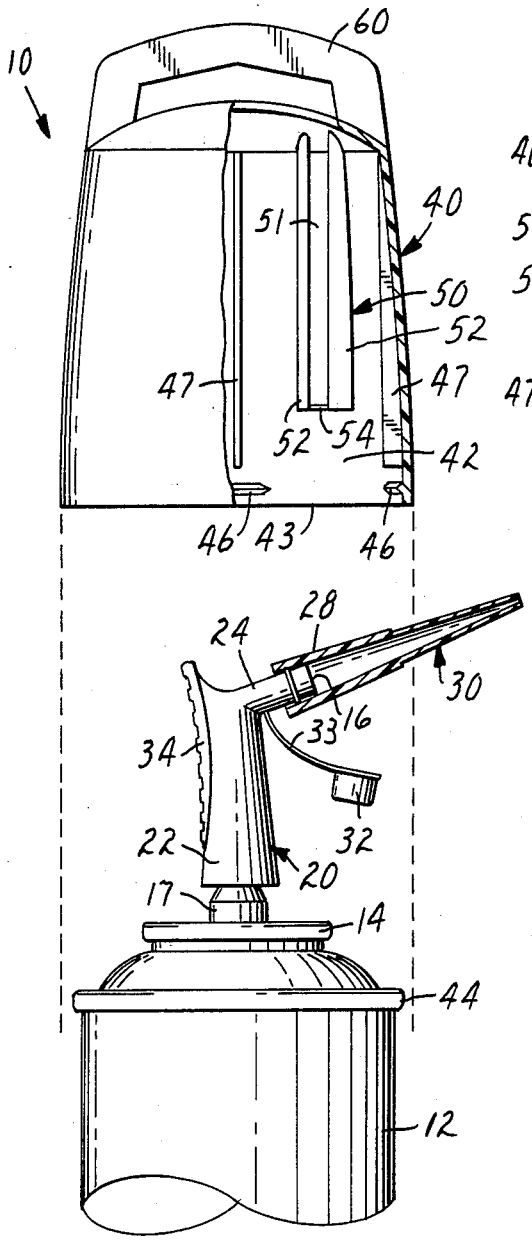
FIG. 1 is a fragmentary side view having parts broken away to show detail of a dispensing assembly according to the present invention illustrated with a tapered nozzle included in the assembly attached to a directing tube thereof and an overcap in which the nozzle is stored prior to use spaced from the directing tube and a container included in the assembly.
Figure 2:
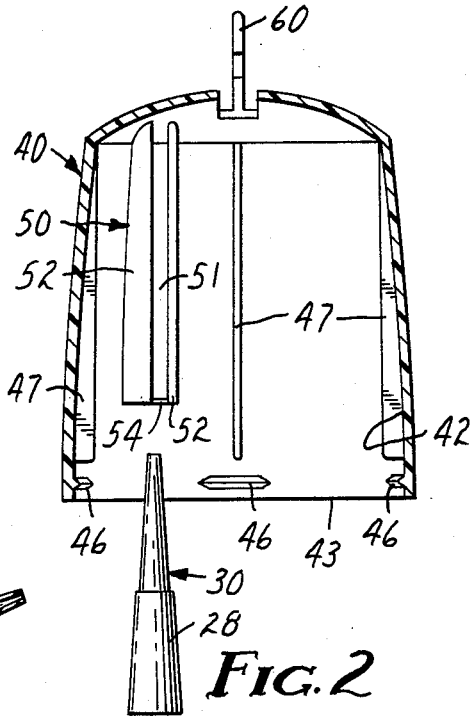
FIG. 2 is a sectional view of the overcap shown in FIG. 1 rotated ninety degrees counterclockwise.
Figure 3:
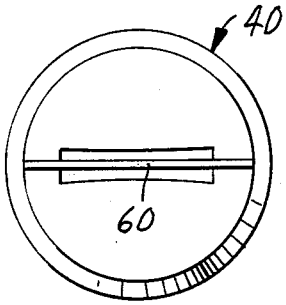
FIG. 3 is a reduced top view of the overcap shown in FIG. 1.

Referring now to FIGS. 1 through 4 there is shown a dispensing assembly according to the present invention generally designated by the reference numeral 10.

The dispensing assembly 10 comprises an internally pressurized container 12 of viscous liquid, which container 12 comprises valve means 14 at the upper end of the container 12 including a hollow projecting stem 17, and means for directing liquid discharged through the valve means 14 to an outlet opening 16 including the stem 17 and a generally L-shaped hollow directing tube 20. The valve means or valve 14 is of a conventional known type (e.g., such as the No. 111 valve commercially available from Clayton Corp., St. Louis, Mo. ) which can retain the pressurized liquid within the container 12 when the stem 17 is in a central position, and can allow flow of the pressurized liquid from the container 12 through the stem 17 and directing tube 20 when the stem 17 is manually pivoted relative to the container 12 about the end of the stem 17 adjacent the container 12.

The hollow generally L-shaped directing tube 20 has an inlet portion 22 frictionally engaged over the outer surface of the stem 17, an outlet portion 24 disposed at an obtuse angle with respect to the inlet portion 22 and having a distal end defining the outlet opening 16. The outer surface of the outlet portion 24 is adapted to be frictionally and releasably engaged by either the tapered inner surface of an inlet end portion 28 of a tapered application nozzle 30 (FIG. 1) or by the inner surface of a cup-shaped cover 32. The cover 32 is integrally molded with the directing tube 20 and attached thereto by a flexible strip 33 so that the cover 32 is movable from a closed position (not shown) over the outlet opening 16 and frictionally engaging the outer surface of the outlet portion 24 to prevent dripping of liquid from the outlet opening 16 and restrict air from contacting liquid within the directing tube 20 and the stem 17, and an open position (shown in FIG. 1) spaced from the outlet portion 24 to afford flow of liquid through the directing tube 20 when the valve means is opened by pivoting the stem 17 and to afford frictional engagement of the inlet end portion 28 of the application nozzle 30 by which liquid flowing through the directing tube 20 may be positioned in a desired location, such as in a crack between a door or window frame and a wall. The directing tube 20 also includes a pressure plate 34 on the side of the inlet portion 22 opposite the outlet portion 24, which pressure plate 34 is adapted for manual engagement to move the directing tube 20 and thereby the stem 17 to open the valve means 14 and afford flow of liquid from the container 12 through the outlet opening 16.

Figure 4:
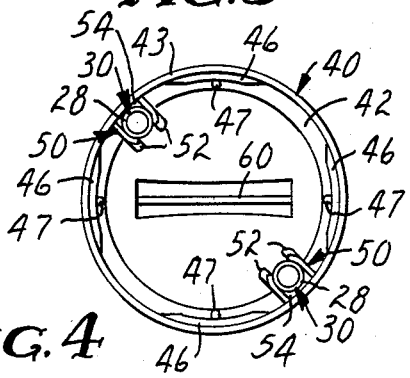
FIG. 4 is a reduced bottom view of the overcap shown in FIG. 1.

Also included in the dispensing assembly 10 is an overcap 40 comprising a wall defining a cavity 42 adapted to receive the stem 17 and directing tube 20, and having a lip 43 defining an inlet opening to the cavity 42. The lip 43 is adapted to flex and releasably engage over a rim 44 at the upper end of the container 12 around the stem 17 and directing tube 20 at which engaged position four spaced annularly disposed inwardly projecting ledges 46 along the lip 43 project beneath the rim 44, and the ends of four spaced axially extending ribs 47 on the overcap 40 engage the upper surface of the rim 44. The wall of the overcap 40 has portions defining two sockets 50 along its upper surface adapted to releasably retain two of the nozzles 30. These portions include two generally straight elongate inner surface portions 51 partially defining the cavity 42 along a generally cylindrical portion of the wall, which elongate surface portions 51 extend longitudinally at generally right angles with respect to the lip 43, spaced retaining wall portions 52 projecting from opposite sides of each of the elongate surface portions 51 into the cavity 42, which retaining wall portions 52 are more closely adjacent at their distal ends than at their proximal ends, and detents 54 extending transverse of the elongate surface portions 51 at their ends adjacent the lip 43 of the overcap 40. Prior to use, the nozzles 30 can be releasably retained along the elongate surface portions 51 by the retaining wall portions 52 (as is shown in FIG. 4) which are shaped to prevent the inlet end portions 28 of the nozzles 30 from slipping past the detents 54, and either nozzle 30 can be longitudinally slid from between the adjacent surface portion 51 and retaining wall portions 52 for use as shown in FIG. 1 by pulling on the nozzle 30 so that the retaining wall portions 52 deflect outwardly to allow the nozzle 30 to pass the detent 54.

As illustrated, the overcap 40 may further include a loop-like hanger portion 60 at its end opposite the lip 43, which hanger portion 60 has a through opening adapted to receive a support member (not shown) from which the dispensing assembly 10 may be hung when the overcap 40 is engaged with the container 12.

Prior to use of the dispensing assembly 10, the two application nozzles 30 will be stored in the two sockets 50 in the overcap 40 and the overcap 40 will be releasably engaged with the container 12. To use the dispensing assembly 10, a user separates the overcap 40 from the container 12 by pivoting the overcap 40 sideways relative to the container 12, and removes one of the nozzles 30 from its socket 50. The removed nozzle 30 may be used as is or cut to shorten its length and provide a larger outlet opening if that is desired. The inlet end portion 28 of the removed nozzle 30 is then pressed over the outlet portion 24 of the directing tube 20 (FIG. 1) and the dispensing assembly is ready for use. Liquid from the container can then be applied (as in a crack or space between a door or window frame and a wall) by manually pressing on the pressure plate 34 to deflect the directing tube 20 and stem 17 and cause liquid to flow past the valve means 14 and nozzle 30 into the area in which the outlet end of the nozzle 30 is inserted. When sufficient liquid has been dispensed, the nozzle 30 is removed and, if desired, cleaned and returned to its socket 50. The cover 32 is pressed over the outlet portion 24 of the directing tube 20 to stop liquid from dripping from the outlet opening 16 and restrict air from contacting the liquid in the directing tube 20 and stem 17, and the overcap 40 can again be engaged with the container 12 whereupon the dispensing assembly 10 can, if desired, be stored by hanging it on a projection received in the opening beneath the hanger portion 60 on the overcap 40.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. A dispensing assembly comprising:

an internally pressurized container of viscous liquid;

valve means mounted on said container including a hollow projecting stem having an outlet opening, said valve means retaining said liquid within said container when said stem is in a central position, and allowing flow of the pressurized liquid from the container through said stem when the stem is pivoted relative to the container about the end of the stem adjacent the container;

means engaged with said stem and having an outlet opening for directing liquid discharged from said stem;

an elongate hollow application nozzle having a through opening, an inlet end adapted for engagement with said means for directing with said outlet opening communicating with said through opening, and an outlet end opposite said inlet end; and an overcap comprising a wall having an inner surface defining a cavity adapted to receive said means for directing and having a lip defining an inlet opening to said cavity, said lip being adapted to releasably engage said container with said means for directing received in said cavity, said wall of said overcap having a socket along said inner surface, and said nozzle being releasably retained within said socket.

2. A dispensing assembly according to claim 1 further including means for sealing said outlet opening.

3. A dispensing assembly according to claim 1 wherein said wall has at least one elongate surface portion partially defining said cavity and extending longitudinally at generally a right angle with respect to said lip, and said wall includes spaced retaining wall portions projecting from opposite sides of said elongate surface portion into said cavity and being more closely adjacent at their distal ends than at their proximal ends, and a detent extending transverse of the elongate surface portion at its end adjacent said lip with said elongate surface portion and retaining wall portions defining said socket with said nozzle being releasably retained along said surface portion by said retaining wall portions and detent.

4. A dispensing assembly according to claim 3 wherein said overcap includes two sockets each defined by an elongate surface portion partially defining said cavity extending longitudinally at generally a right angle with respect to said lip, and said wall includes spaced retaining wall portions projecting from opposite sides of both of said elongate surface portions, which retaining wall portions adjacent each of said elongate surface portions are more closely adjacent at their distal ends than at their proximal ends, and a detent extending transverse of each elongate surface portion at its end adjacent said lip; and said assembly includes two of said elongate hollow nozzles each releasably retained along a different one of said elongate surface portions by said retaining wall portions and said detent.

5. A dispensing assembly according to claim 1 wherein said means for directing further includes a hollow generally L-shaped directing tube having an inlet portion frictionally engaged over said stem, an outlet portion disposed at an obtuse angle with respect to said inlet portion and having a distal end defining said outlet opening, said outlet portion being adapted to be frictionally engaged by the inlet end of said tapered nozzle; and a pressure plate on the side of said inlet end portion opposite said outlet end portion adapted for manual engagement to move said directing tube and thereby said stem to open said valve means and afford flow of liquid from said container through said outlet opening.

6. A dispensing assembly according to claim 5 further including a cover movable from a position over said outlet opening and frictionally engaging said outlet portion and a position spaced from said outlet portion.

7. A dispensing assembly according to claim 1 wherein said overcap further includes a hanger portion at its end opposite said lip, said hanger portion having a through opening adapted to receive a support member from which said dispensing assembly may be hung when said overcap is engaged with said container.

* * * * *